United States Patent [19]

Morgan

[11] 4,137,690

[45] Feb. 6, 1979

[54] APPARATUS FOR WRAPPING PAPER ROLLS

[75] Inventor: James A. Morgan, Covington, Va.

[73] Assignee: Westvaco Corporation, New York, N.Y.

[21] Appl. No.: 833,299

[22] Filed: Sep. 14, 1977

[51] Int. Cl.[2] ..... B65B 11/04

[52] U.S. Cl. ..... 53/176; 53/211; 53/380

[58] Field of Search ..... 53/13, 27, 32, 42, 176, 53/128, 196, 204, 210, 211, 212, 214, 378, 380; 93/39.1 R, 55.1 R

[56] References Cited

U.S. PATENT DOCUMENTS

| | | | |
|---|---|---|---|
| 1,136,412 | 4/1915 | De Blonay | 53/212 |
| 1,612,262 | 12/1926 | Coggins et al. | 53/214 |
| 1,689,430 | 10/1928 | Gwinn | 53/32 |
| 2,368,213 | 1/1945 | Gerlach | 53/32 X |
| 3,605,382 | 9/1971 | Andersson | 53/380 |
| 3,633,335 | 1/1972 | Johnson | 53/380 |
| 3,660,958 | 5/1972 | Garrison | 53/27 X |
| 3,710,539 | 1/1973 | Cothran et al. | 53/27 |
| 3,921,803 | 11/1975 | Reed et al. | 53/13 X |
| 3,924,375 | 12/1975 | Brenner et al. | 53/211 X |

*Primary Examiner*—John Sipos

*Attorney, Agent, or Firm*—W. Allen Marcontell; Ernest B. Lipscomb, III

[57] ABSTRACT

Large mill reels of paper are protectively wrapped for shipment by a method which first caps the reel end-faces with a header disk having a diameter greater than the reel diameter. The flange of excess disk material is pleated and pressed into a band of adhesive applied about the reel circumference near the respective end-face. Subsequently, a second band of adhesive is applied to the two pleated and pressed flanges around the reel circumference and a circumferential surface wrap of width substantially equal to the axial length of the subject reel is applied thereabout.

5 Claims, 8 Drawing Figures

APPARATUS FOR WRAPPING PAPER ROLLS

BACKGROUND OF THE INVENTION

1. Field of the Invention

The present invention relates to the art of packaging or protective wrapping large diameter reels of paper for transport.

2. Description of the Prior Art

The finished product of the papermaking process is a continuously issued web approximately twenty feet (6 meters) wide. For shipment to customers and converters, the web is slit into a multiplicity of more manageable widths and wound into cylindrical reels or rolls of normally three to six feet in diameter. Shipment weights of such rolls may range from 1700 to 9200 pounds.

To protect such finished reels of paper from handling and shipment damage, the usual industry practice is to wrap the reels with a heavy grade of paperboard.

The presently prevailing technique for such reel wrapping is to draw a strip of wrapping board from a supply reel of greater axial length than the reel to be protected. This web strip is wrapped tightly about the cylindrical surface of the protected reel. The axially overhanging portion of the circumferential wrap is crimped radially inward toward the reel center and tightly creased against the circular reel ends. To seal the reel ends and hold the crimps down against the end faces, two circular header disks of approximately the same diameter as the protected reel are used at each reel end-face. One disk is inserted within the surface wrap overhang flush against the reel end-face. Adhesive is then applied to the outer face of this first or inner disk. Next, the overhanging portion of the surface wrap is crimped and pleated into the inner disk adhesive. Thereafter, a second or outer disk having adhesive applied to the inner face thereof is pressed against the outer face of the surface wrap pleats.

Prior Art Statement

U.S. Pat. Nos. 3,924,375; 3,828,523; 3,633,335; 3,577,703; 2,893,191; and 2,644,282 disclose numerous methods and apparatus to mechanize the aforedescribed wrapping technique.

U.S. Pat. No. 3,924,375 describes an apparatus for incrementally pleating the overhanging portion of a cylindrical surface wrapping sheet against the reel end-face.

U.S. Pat. No. 3,828,523 describes an apparatus for holding an inner reel disk header in place while the overhanging portion of a surface wrapping sheet is incrementally folded over the end corner and pleats formed against the reel end-face.

U.S. Pat. No. 3,633,335 describes a rotating star-wheel apparatus for incrementally folding the overhang of a surface wrapping sheet over a reel end-corner into a follower roll nip to be pleated and creased against the roll end-face.

U.S. Pat. No. 3,577,703 describes a rotating cylinder having a helical groove cut into the surface thereof for incrementally folding the overhanging portion of a surface wrapping sheet over the reel end-edge and creasing the resulting pleat against the reel end-face.

U.S. Pat. No. 2,893,191 describes a rotating disk apparatus for incrementally folding the overhanging portion of a surface wrapping sheet over the reel end-edge and creasing the resulting pleat against the reel end-face.

U.S. Pat. No. 2,644,282 describes an apparatus for incrementally folding the overhanging portion of surface wrapping sheet over the reel end-edge and creasing the resulting pleat against the reel end-face by rolling the reel along a floor line with a surface drive belt applied to the upper tangent of the roll. The folding and pleating device is secured to the floor along the roll line and the reel end-face is pressed thereagainst.

Common to all such prior art apparatus and characteristic of the wrapping method, in general, is the need for header disks of substantially the same diameter as the reel. If several different diameter sizes are prepared for shipment by the producing mill, it is necessary to make or purchase and store such respectively sized header disks preparatory to use.

Moreover, the mere need of several sizes of header disks creates a material handling obstacle at a reel wrapping station where several different reel sizes are wrapped in mixed succession. As the reel is circumferentially wrapped, the operator must select the proper disk size and manually place it against the reel end-face within the overhanging flange of wrapping material that is to serve as the crimped pleats.

Although these tasks are neither difficult nor excessively time consuming under relaxed conditions, in many cases the papermachine produces more rapidly than the product can be wrapped: even with the aid of semiautomatic equipment such as that disclosed above.

An object of the present invention, therefore, is to teach a method and apparatus for practicing the method whereby an accurate, insert placement of roll wrapping header disks is avoided.

Another object of the invention is to teach a method of wrapping a wide diameter range of paper reels using only one diameter size of header disk.

SUMMARY OF THE INVENTION

These and other objects of the present invention are accomplished by the method of first applying a band of adhesive, either glue or double-faced tape, around the reel circumference at both axial ends thereof. Next, a header disk having a diameter greater than the subject reel is positioned against the respective reel end-faces and crimped into the adhesive band with the crimp pleats lying against and around the circumferential surface of the roll. Finally a circumferential wrap is adhesively applied over the header disk pleats and the circumferential surface of the reel therebetween.

Apparatus to practice the present method broadly includes a header crimping assembly which comprises two crimping units; one secured in a fixed position to operate opposite one end-face of the subject reel and the other mounted to be moved toward or away from the first along a line parallel with the subject reel axis for operation opposite the other end-face of the subject reel.

Each crimping unit includes a vertically adjustable carrier beam for mounting a spring spoked crimping wheel on one side of the vertical center plane through the reel axis and a respective axial end of a crimp press roller which spans between the two carrier beams on the opposite side of such center plane.

Additionally, each crimping unit includes an independently, vertically adjusted header holding press having a rotatable platen for clamping a header sheet to the subject reel end-face during the header flange crimping process.

For rotatably supporting a subject reel, two carrier axles are provided to span between the crimping units near the bottom or floor line end thereof. One such axle is driven. The other is an idler. The reel carrier surface for at least the driven axle is divided with one portion thereof being axially shiftable with the movable crimping unit.

In an alternative embodiment of the invention apparatus, a rotatable spoked frustum of a cone is used for initially spacing and setting the header flange pleats.

BRIEF DESCRIPTION OF THE DRAWING

Relative to the several figures of the drawing wherein an identity of reference characters designates the same or similar elements.

DESCRIPTION OF THE PREFERRED EMBODIMENTS

Figure 1B:
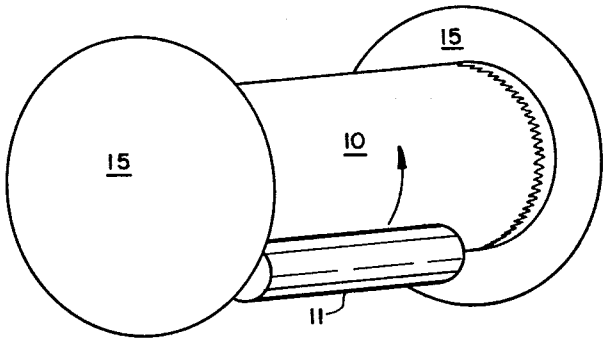
FIG. 1 illustrates the progressive series of steps representative of the present invention method.
Figure 1D:
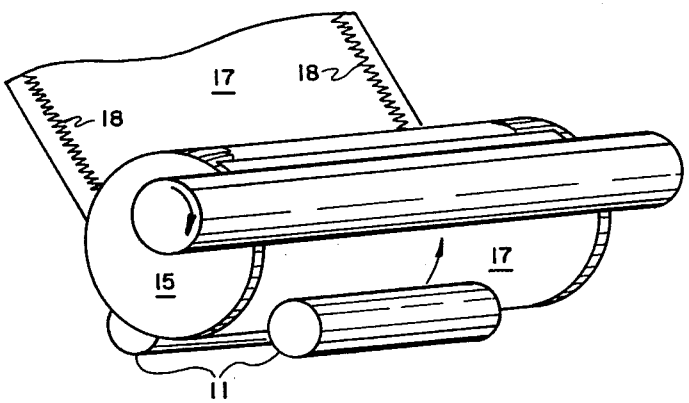
Figure 1A:
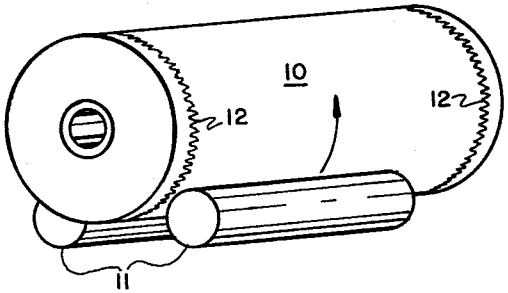

The basic method of the invention is illustrated by the drawing sequence of FIGS. 1A through 1D. FIG. 1A represents a reel 10 cradled between a pair of powered support rollers 11. Such rollers are well known to the prior art and are normally mounted on a platform structure recessed below floor level. The entire roller support assembly is vertically adjustable so that the subject reel 10 may be manually or gravity rolled along the floor into cradle alignment between the roller 11 pair. Thereafter, the reel support assembly is raised for additional clearance from the floor.

Either before or after cradling between rollers 11, strips of adhesive 12 are applied around the circumferential surface of reel 10 near both axial ends thereof. Such adhesive may be of any suitable flow or brush applied type and may also comprise respective strips of double-faced tape.

Figure 1C:
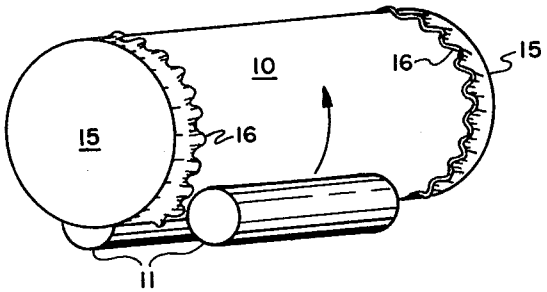
Figure 2:
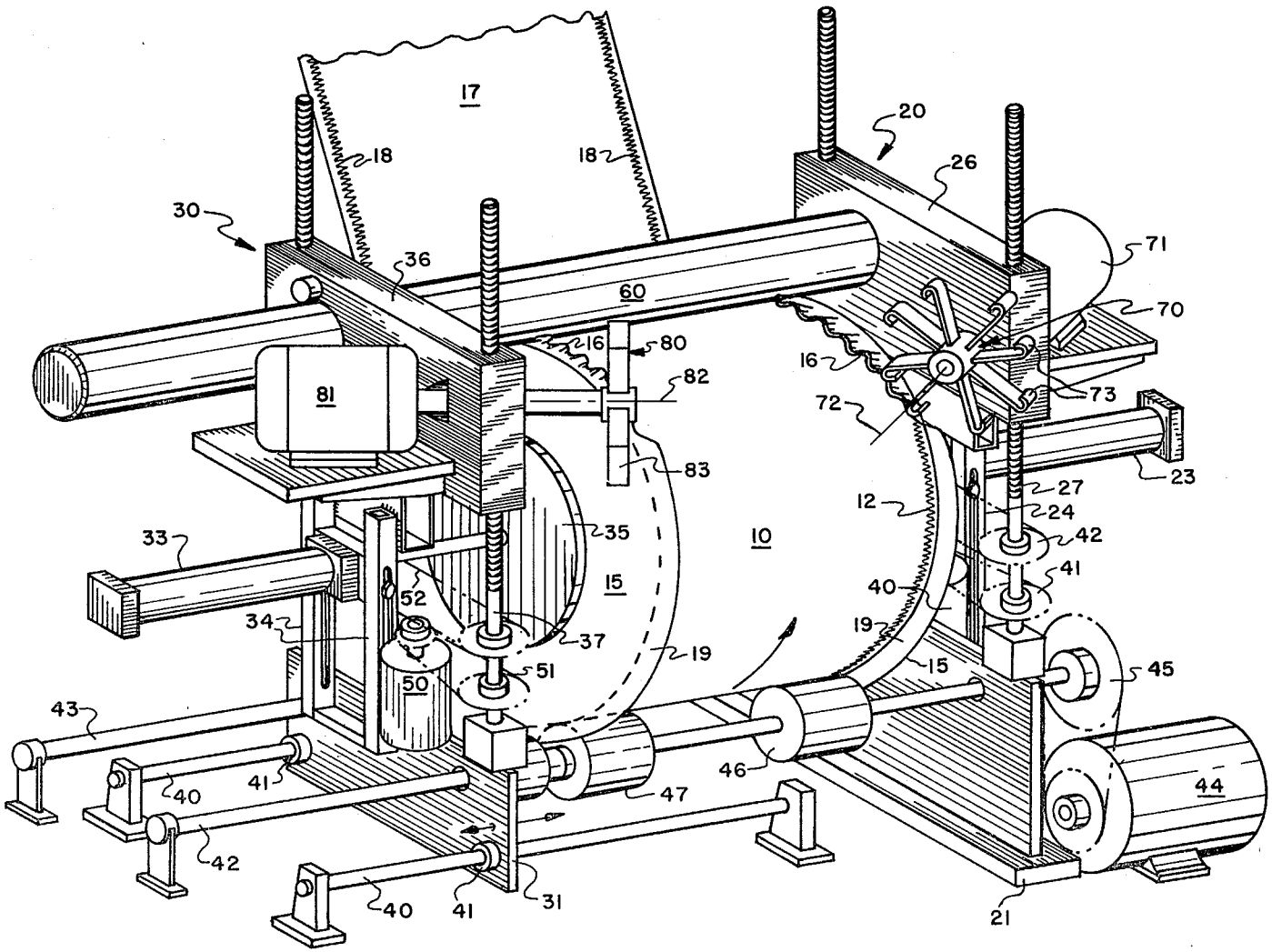
FIG. 2 is an isometric perspective of the present apparatus assembly.
Figure 3:
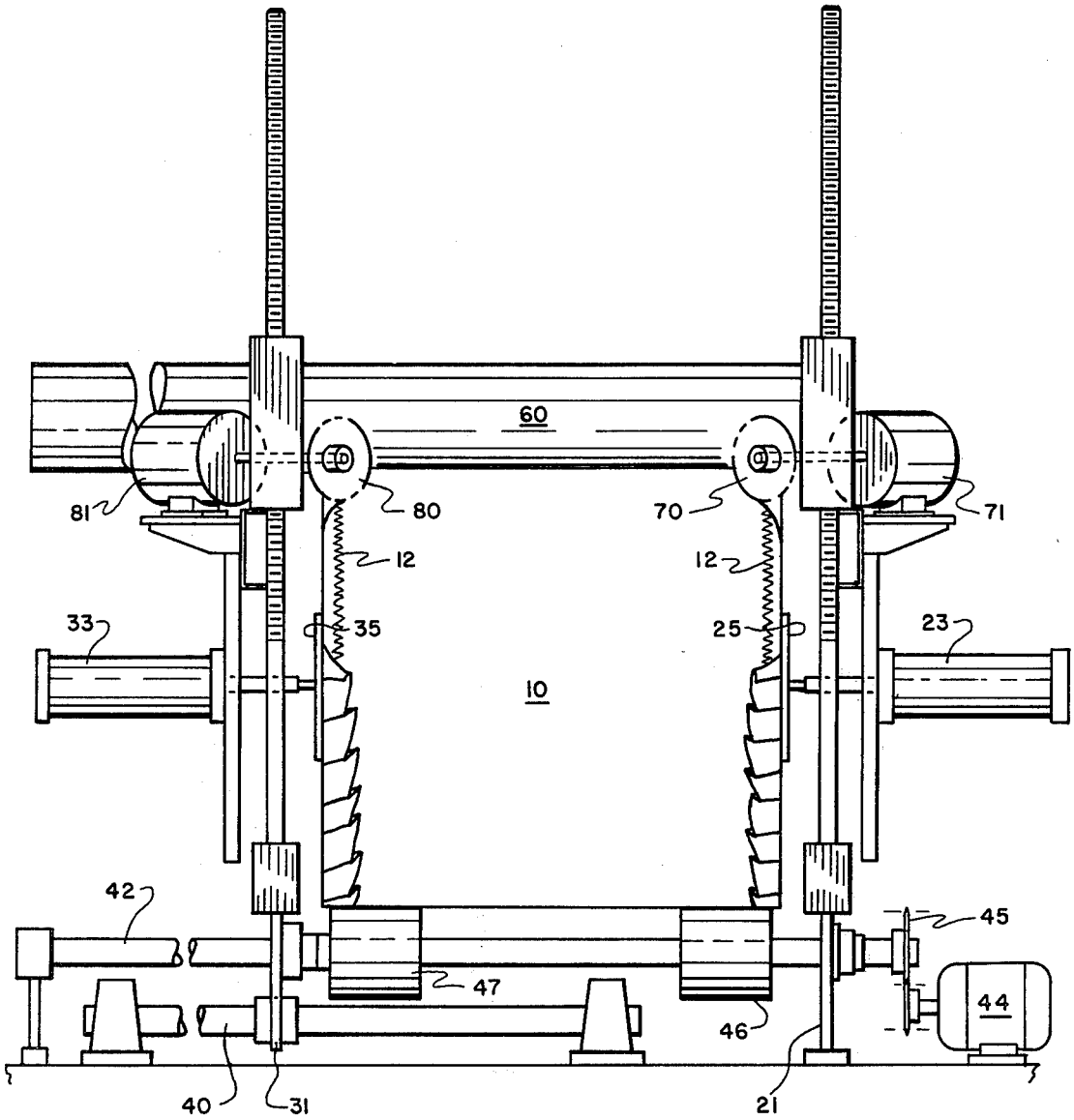
FIG. 3 is an orthographic elevation of the apparatus illustrated by FIG. 2.

FIG. 1B illustrates the application of the reel end headers 15 which are paperboard disks of substantially greater diameter than the subject reel 10. These headers 15 are coaxially held against the reel 10 ends while the next step of the method proceeds as illustrated by FIG. 1C.

That outer annular portion of the headers 15 defined by the difference between the reel 10 diameter and the outer rim diameter of the headers 15 is creased over a circular end edge of the reel 10 and pressed into the adhesive band 12. Since the paperboard material of the headers 15 has little resilience, a material excess must be accommodated. Although there are numerous techniques for such accommodation, such as slitting and notching, the technique of pleating is normally the most practical. There are also two general categories of pleating, either of which is suitable for use with the present invention. One pleating category comprises a relatively long chordal fold over the reel 10 edge with the material excess at the header 15 rim being tucked into a triangular shaped double layer, the under face of which is pressed into the adhesive band 12. The other general category of pleating is illustrated by FIG. 1C and comprises a series of line elements of the header 15 annulus folded at the reel 10 end edge to extended parallel with the reel 10 axis and pressed into the adhesive band 12. This technique forms a series of tapered length, sinusoidal flutes 16. Subsequently, the flutes may be pressed against the circumferential surface of the reel 10, either manually or by rotation of the reel 10 with the powered rollers 11.

The final step of the present wrapping method is represented by FIG. 1D wherein an outer wrapping sheet 17 having a width substantially equal to the axial length of the reel 10 is applied over the flattened pleats 16 and adhesively secured thereto. As in the case of adhesive bands 12, adhesive bands 18 may be either fluidized adhesive or tape and furthermore, may be applied to the under surface of outer wrap 17 as illustrated by FIG. 1D or, onto the flattened pleat surface 16.

Examination of the present method will reveal that little criticality is required in the size of the headers 15 beyond a pleating annulus that is sufficient to hold the pleats in place until the outer wrap 17 is applied. Consequently, a single header size may be dimensioned to accommodate the largest reel diameter of a broad range. Smaller diameter reel 10 simply will have additional material pleated and flattened against the circumferential surface of the reel where the presence thereof offers no interference to the outer wrap 17 and provides additional layers of protective material for the reel 10 substance.

A preferred embodiment of apparatus to practice the aforedescribed method is illustrated by FIGS. 2–5. Relative to FIG. 2, there is shown an assembly comprising two crimper units 20 and 30 disposed opposite from the end-faces of reel 10.

Crimper unit 20 is secured to a stationary base 21 whereas unit 30 is secured to a movable base 31. A stationary pair of parallel guide bars 40 having a slip fit relation with bushings 41 control the facing orientation of the unit 30 relative to stationary unit 20. Power means such as a fluid motor, not shown for reasons of simplification, may be applied to the unit 30 for desired positionment thereof relative to the unit 20. Such positionment is dictated by the axial length of reel 10.

Also passing through the base 31 of unit 30 are two reel supporting axles 42 and 43. Axle 42 is driven by motor 44 and power transmission 45 whereas axle 43 is an idler shaft. The direction of reel 10 rotation relative to the position of powered and idler axles is critical.

Both support axles 42 and 43 are provided with roller sleeves 46 and 47. The sleeves 46 and 47, relative to axle 42, are keyed or splined to transmit torque. Additionally, roller sleeves 46 relative to both axles 42 and 43 are fixed along the axial length thereof. However, sleeves 47, relative to both axles 42 and 43, are rotatably secured to the movable base 31. Accordingly, both sleeves 47 respective to both axles 42 and 43 maintain a fixed distance relationship from movable base 31 and the axle 42 also transmits drive torque to its respective sleeve 47.

The base components of the invention are preferably recessed in the supporting floor to facilitate receipt and discharge of a reel 10 by the sleeves 46 and 47. If the upper sleeve tangent is set level with the floor, reels 10 may be rolled manually into position between the two axles 42, 43. However, the arc of tangency between the sleeves 46 and 47 causes an elevational drop of the reel when so positioned. Consequently, work is required to lift the roll from between the axles 42 and 43. This is circumstance as well known by the prior art and is accommodated by a powered elevator shoe not shown that is located between the axles.

Aligned in the vertical center plane passing between the axles 42 and 43 are rams 23 and 33. Vertical positionment of these rams is adjustable relative to respective support pedestals 24 and 34. The stroke of such rams 23 and 33 may be fluid actuated for the purpose of temporarily clamping header disks 15 to the opposite end-faces of reel 10. Platens 25 and 35 are rotatably secured to the reciprocating end of the respective rams to permit rotation of the reel 10 about its respective axis under clamping pressure.

Above the respective bases 21 and 31 are provided carrier beams 26 and 36 supported by rotatable jack-shafts 27 and 37. Coordinated drive motors 40 and 50 rotatably drive one jack-shaft 27, 37 of a unit pair via chain transmissions 41, 51 and link drives 42, 52 rotate the other jack-shaft of the pair. Cooperative threads within the beams 26 and 36 ride the jack-shaft 27, 37 threads to raise or lower the respective beam positions in parallelism by motor 40, 50 rotation of the jack-shafts.

The press roller 60 is rotatably journaled within the laterally fixed carrier beam 26 but axially fixed thereto. Relative to the laterally movable carrier beam 36, however, the press roller 60 is axially slideably as well as rotatable.

Crimp wheels 70 and 80 are driven by respective motors 71 and 81 at a rotational speed that is coordinated to the surface velocity of the reel 10. The rotational axes 72, 82 of the crimp wheels 70, 80 are skewed to the reel 10 axis. Consequently, the rotational plane of the pleat fingers 73, 83 is skewed to the end-face plane of the reel 10. Pleat fingers 73, 83 are of a resilient material such as light spring steel to fold pleated increments 16 of the header flange annulus 19 over the reel 10 end-face edges and into the previously applied adhesive band 12.

Those of skill in the art will appreciate that the skew angle of rotational axes 72, 82 is coordinated with the length of pleat fingers 73, 83 so that the arc traversed by the rotational locus of the finger tips crosses the pleat band area 16 at a point of substantially tangential intersection with the circumferential surface of the reel 10. See FIG. 4. Additionally, the number, diameter and rotational speed of the pleat fingers 73, 83 is coordinated to the surface velocity of the reel 10 so that the relative movement between the fingers and the reel is minimized over the arc of the contact by the fingers 73, 83 with the flange 19 except for that motion component which parallels the reel 10 axis.

Offset alignment of the crimper wheels 70, 80 and support sleeves 47 is referenced to the end-face corner edge of a reel 10. The outside edge of sleeves 46, 47 should be positioned within the distance between adhesive bands 18 to preclude interference therewith. Additionally, clearance must be provided for the skewed rotational plane of crimper wheels 70, 80 which necessarily offsets the critical pleat band 16 from the carrier beam 26, 36.

Another point of machine alignment relates to the lateral positionment of the press roller 60 and the crimper wheels 70, 80. The center of the crimp finger 73, 83 arc across the pleat band 16 should be the substantially equidistant to the point of press roll 60 tangency with reel 10 surface relative to a vertical plane through the reel axis. Since the distance will change modestly for different reel 10 diameters, an average reel 10 diameter value is acceptable. The resiliency of the fingers 73, 83 provides adequate accommodation for the consequential misalignment on reel 10 diameters different from the selected design value.

In operation, the separation distance between crimper units 20 and 30 is set according to the axial length of an anticipated reel 10 by selective positionment of movable unit 30 to align the outside edges of carrier sleeves 46, 47 within the distance between adhesive bands 12.

Physical placement of the reel 10 between axles 42, 43 on the sleeves 46, 47 is usually by manual rolling or gravity ramp. When the reel 10 is located to be supported by the sleeves 46, 47, a header disc 15 is positioned between the reel 10 end-face and the clamping platens 25, 35. The radius of sleeves 46, 47 provides clearance for the lower arc of the disk flange 19. Consequently, the clamped assembly of reel 10 and disks 15 is free to rotate by the drive of motor 44.

The adhesive bands 12 are then applied to the reel 10 surface by conventional means such as extrusion guns or double-faced tape. The bands 12 will remain undisturbed about the full 360° of reel 10 rotation due to the offset of the sleeve 46, 47 outside edge.

With the crimper wheels 70 and 80 rotating at the coordinated speed of motors 71, 81, the carrier beams 26, 36 are lowered by the jack-shaft 27, 37 drive 50, 51, 52 until the press roller 60 tangently contacts the circumferential surface of reel 10.

Figure 4:
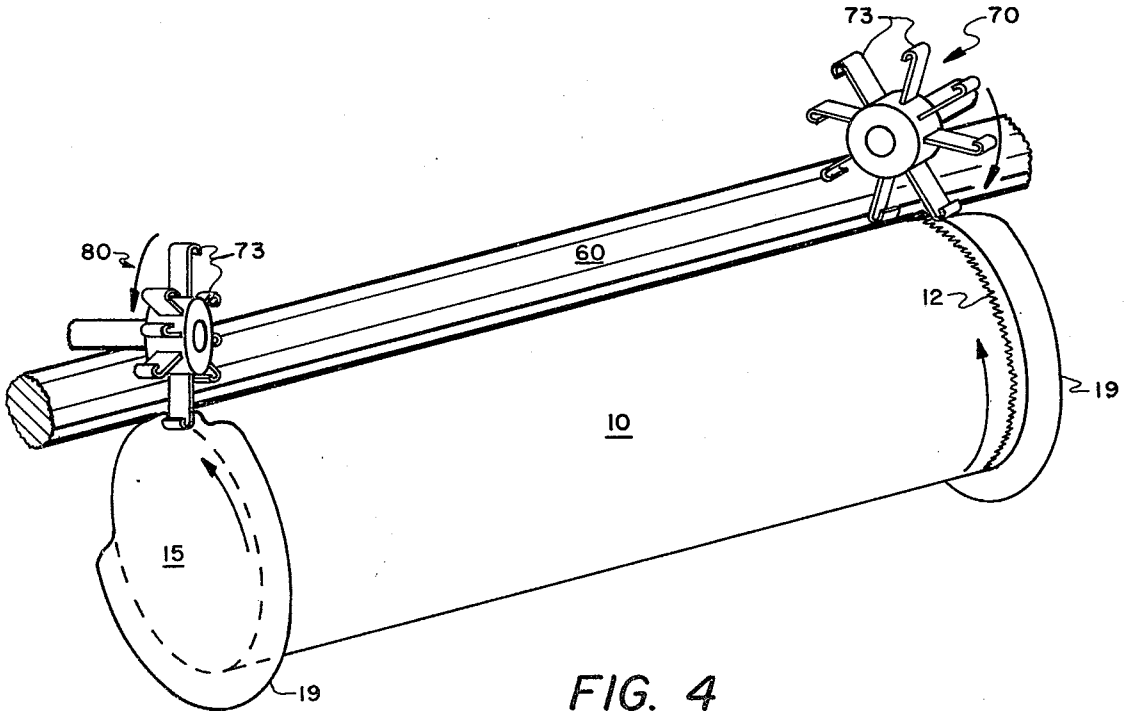
FIG. 4 is a simplified detail for illustrating one crimping and pressing technique of the invention; and, FIG. 5 is a simplified detail for illustrating another crimping technique of the invention.

As best seen from FIG. 4, the direction of reel 10 rotation is such to bring a point on the disk flange 19 past the lower arc of crimper fingers 73, 83 before the same point reaches the press roll 60, the adhesive band 12 is covered by the pleat band 16 before passing under the press roll 60.

As the respective arcs of the crimper fingers 73, 83 and the disk flanges 19 converge to intersection at acute angles, the relative descendency and skewed plane of the crimper fingers 73, 83 bend a pleat increment of the flange 19 over the reel 10 end-face edge and into wiping, pressing contact with adhesive 12. Such contact is sufficient to hold the pleats down along the pleat band 16 arc increment between the crimper wheels 70, 80 and the press roller 60 line of tangency.

Under the nip pressure of the press roller 60, the pleat band is firmly pressed and creased against the reel 10 surface into the adhesive 12.

Upon emergence of a pressed segment of the pleat band 16 from the press roll 60 nip, the leading edge of a circumferential wrapping sheet 17 drawn from a supply reel not shown and prepared with lateral adhesive bands 18 may be positioned as the reel 10 rotates. Accordingly, crimping, pressing and surface wrapping functions are executed simultaneously.

When a 360° wrap quantity of surface sheet 17 has been applied, the entire protective wrap of the reel 10 is complete. Carrier beam 26, 36 are lifted by the jack-shafts 27, 37 to disengage the press roller 60 and crimper wheels 70, 80 from the finished surface of reel 10.

Operation of the aforedescribed elevator (not shown) disposed between axles 42, 43 will lift the finished reel from the saddle between sleeves 46, 47 to permit manual removal from the wrapping station.

Figure 5:
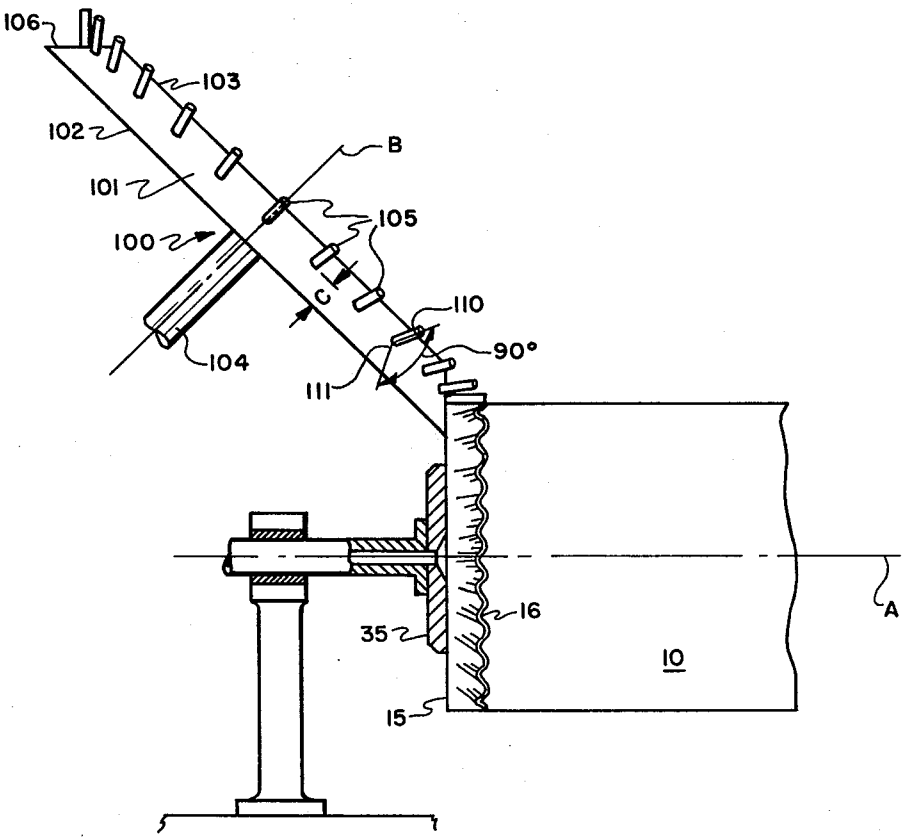

An alternative embodiment of the crimper wheels 70, 80 is illustrated by FIG. 5. Exaggerated perspective is used to illustrate characteristics distinctive to this embodiment. Within the complete machine described relative to FIGS. 2 and 3, the crimp wheel 100 is substituted for the resilient finger wheels 70, 80 except for the skew angle of the drive shaft. The axis B of axle 104 is disposed in a common plane with reel 10 axis A. The hub 101 of wheel 100 is a normal frustum of a normal cone and therefore includes major and minor circular faces 102 and 103, respectively. The cone angle of the frustum surface 106 is coordinated with the axes A and B to provide a line of tangency between the rotational locus of the surface 106 and the plane of the reel 10 end-face. Dowels 105 are set normal to the surface 106, spaced substantially equally about the circle thereof and offset from the major surface 102 by a distance C to provide a sharp, 90° angle between the tangential lines of intersection of dowel surface element 110 with the reel surface and cone surfaces element 111 with the reel end-face plane.

In operation, rotation of the wheel 100 is coordinated with rotation of reel 10 to minimize tangential relative velocity between the dowels 105 and the reel 10 surface. Accordingly, as the arc of the dowels 105 engages the plane of the disk flange 19, a portion of the flange is pushed down into the adhesive 12 thereby forming pleats of the excess flange material between the lines of contact with adhesive 12. These pleats are subsequently pressed flat in the nip under press roll 60.

Particularly distinctive about the crimp wheel 100 operation is the sharp angle, neatly secured edge at the brake-fold of flange 19 over the reel end-face edge. Moreover, because of the arc of clamping surface provided by the length C of conical surface 106 against the reel end-face area of disk 15, the disk is positively confined from buckling away from the end-face during the crimping operation thereby leaving the entire end-wrap tight and neatly creased around the entire roll 10 circumference.

I claim:

1. Apparatus for protectively wrapping a cylindrical reel of paper with header sheets of greater surface area than respective end-faces of said reel, said header sheets area exceeding said end-face area by an excess area which is folded upon the cylindrical surface of said reel and overlaid with a circumferentially wrapped sheet, said apparatus comprising first means to axially rotate said reel in a laterally stationary position and second means to secure said header sheets in position against said reel end-faces simultaneous with said reel rotation, the improvement comprising:

pleating wheel means to fold said excess header area over the edge junction between said reel end-faces and said cylindrical surface, said excess area being sequentially pleated and creased against said cylindrical surface as said reel revolves about said reel axis, said pleating wheel means comprising a plurality of finger elements projecting radially from respective second axes of rotation, said second axes of rotation being skewed to the respective planes of corresponding reel end-faces whereby rotational planes traversed by said finger elements converge to intersection with said end-face planes and said excess area portion thereof at acute angles.

2. Apparatus as described by claim 1 wherein said pleating wheel means comprises an axle mounted hub having a plurality of resilient fingers projecting radially therefrom, the rotational plane of said fingers positioned in skewed alignment to respective end-face planes of said reel.

3. Apparatus as described by claim 1 wherein said pleating wheel means comprises an axle mounted frustum of a cone means, said cone means having a plurality of spoked projections extending normally from the surface of said cone, said projections being substantially equally spaced about a circular surface element of said cone whereby a locus of axial rotation of said projections tangentially meets the cylindrical surface of said reel.

4. Apparatus as described by claim 3 wherein the rotational locus of said conical surface tangentially meets the plane of an end-face of said reel.

5. Apparatus as described by claim 4 wherein said projections extend parallel with the axis of said reel at a point of tangential meeting with said cylindrical reel surface.

* * * * *